US006256971B1

(12) United States Patent
Kimura et al.

(10) Patent No.: US 6,256,971 B1
(45) Date of Patent: Jul. 10, 2001

(54) INDIVIDUAL-SPINDLE-DRIVE TYPE MULTIPLE TWISTER

(75) Inventors: Tatsuo Kimura, Nara; Toshinari Umeoka, Uji, both of (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/522,827

(22) Filed: Mar. 10, 2000

Related U.S. Application Data

(62) Division of application No. 09/313,786, filed on May 17, 1999.

(30) Foreign Application Priority Data

Jul. 14, 1998 (JP) ..... 10-199237
Jul. 14, 1998 (JP) ..... 10-199238

(51) Int. Cl.[7] ..... D01H 13/00

(52) U.S. Cl. ..... 57/100; 57/58.49; 57/92; 310/45; 310/46; 310/67 R; 310/90; 310/154

(58) Field of Search ..... 57/58.49, 92, 100; 310/45, 46, 67 R, 90, 154

(56) References Cited

U.S. PATENT DOCUMENTS 3,742,268 6/1973 Volkrodt .
4,361,004 * 11/1982 Hartmannsgruber ..... 57/100
4,908,534 * 3/1990 Gubler et al. ..... 310/45
5,111,647 * 5/1992 Gabalda ..... 57/100
5,572,859 11/1996 Derichs et al. .

FOREIGN PATENT DOCUMENTS 4-119130 4/1992 (JP) .

* cited by examiner

*Primary Examiner*—John J. Calvert
*Assistant Examiner*—Shaun R Hurley
(74) *Attorney, Agent, or Firm*—Armstrong, Westerman, Hattori, McLeland & Naughton, LLP

(57) ABSTRACT

In an individual-spindle-drive type multiple twister that directly employs separate motors to drive the spindle shafts of each twisting unit, when a spindle is inserted into the housing during motor assembly, a rotor and a stator may attract each other and adhere to each other, and this attraction may prevent the spindle shaft from being correctly inserted into a target bearing, thus making it difficult to assemble the motor. A spindle shaft 4 is rotatably supported by bearings 27*a* and 28*a* mounted onto upper and lower supporting members 27 and 28. The distance A between the lower end of the rotor magnet 32 of the drive motor 10 fixed to the spindle shaft 4 and the lower end of the spindle shaft 4 is longer than the distance B between the upper end of the stator coil 31, which is fixed to the housing 34 of the drive motor 10, and the bearing 28*a* of the lower supporting member 28. In addition, the tip 4 of the spindle shaft 4*c* is tapered to facilitate insertion.

4 Claims, 12 Drawing Sheets

INDIVIDUAL-SPINDLE-DRIVE TYPE MULTIPLE TWISTER

This application is a division of prior application Ser. No. 09/313,786 filed May 17, 1999.

FIELD OF THE INVENTION

The present invention relates to an individual-spindle-drive type multiple twister comprising a multiple twister that twists a yarn several times while a single spindle shaft is being driven and rotated once, wherein the spindle shaft is directly rotated by a motor.

BACKGROUND OF THE INVENTION multiple twisters that twist a yarn several times while a single spindle shaft is driven and rotated once are conventionally known and are configured in such a way that one driving belt is wound across a large number of spindle shafts arranged in a line to drive the spindle shafts concurrently.

In such concurrent-drive type multiple twisters driven by the belt, since the driving belt is driven in the state that the driving belt pressure-contacts the spindle shafts and imparts a radial force to the bearing portions of the spindle shafts, a high level of noise may occur or a significant amount of power may be lost because the one drive belt is used to drive a large number of spindle shafts.

Thus, in order to reduce noise and power losses, an individual-spindle-drive type multiple twister has been proposed in which a motor is provided for each twisting unit to directly drive the spindle shaft.

In one of the configurations using the motor to directly drive the spindle shaft in the above manner, the motor is configured by, for example, mounting a rotor onto the spindle shaft and disposing a stator opposite to the rotor, and the rotor is composed of a permanent magnet.

In recent years, to increase twisting efficiency and thereby improve productivity, and so on, the magnetic force of the permanent magnet constituting the rotor has been increased to enhance the drive power of the motor and thus the high rotational speed of the spindle shaft is obtained.

The motor that directly drives the spindle shafts can be configured by, for example, securing a permanent magnet, acting as a rotor, to the spindle shaft, securing a core coil, having an iron core and acting as a stator, to the inner circumferential surface of a housing covering the outer circumferential surface of the spindle shaft, and configuring the rotor and the stator mutually opposite to each other, and then, the motor is assembled by inserting the spindle shaft with the rotor fixed thereto into the housing with the stator fixed thereto, so that the spindle shaft is rotatably supported by a bearing after the motor is assembled.

In the motor configured in this manner, if the magnetic force of the permanent magnet constituting the rotor is increased, an attractive force generated between the rotor and the iron core of the coil constituting the stator increases, and thus, when the spindle shaft is inserted into the housing, if the rotor approaches such as the iron core of the stator before the spindle shaft is supported by the bearing, the rotor and the stator attract each other strongly and may stick to each other or hinder the spindle shaft from being inserted into the bearing appropriately, thereby preventing the motor from being assembled easily.

In addition, to increase twisting efficiency and thereby improve productivity and so on, the magnetic force of the permanent magnet constituting the rotor is increased to enhance the drive power of the motor and thus the motor rotes at the high rotation speed, however, to allow the motor to provide sufficient drive power, it is important even during high rotation speed to prevent the motor from becoming hot and prevent magnetic interference between the housing of the motor and the internal magnet. In addition, in case the motor does become hot, it is important to cool it efficiently.

Furthermore, when using the motor to drive the spindle shaft stably at high rotation speed, it is important to minimize the deflection of the spindle shaft by supporting the spindle shaft firmly or reducing the interval between the motor and a rotating disc that rotates integrally with the spindle shaft.

In addition, in the configuration using the motor to directly drive the spindle shaft, the spindle shaft is rotatably supported via a bearing on a supporting base fixed to a frame, and if, for maintenance and so on, a lubricating oil is supplied to the bearing that supports the spindle shaft, this operation is performed after allowing the spindle shaft to protrude upward from the supporting base. If the apparatus is configured in such a way that the lubricating oil is supplied to the bearing after allowing the spindle shaft of a twisting unit to protrude upward from the supporting base, as described above, the lubricating oil supply operation is cumbersome and a larger space is required in the vertical direction, resulting in the need to increase the size of the individual-spindle-drive type multiple twister.

Thus, a lubricating oil supply passage may be formed in a supporting portion for supporting the spindle shaft so that the lubricating oil can be externally supplied while the spindle shaft is being supported by the bearing. However, in the configuration using the motor to directly drive the spindle shaft, the spindle shaft is supported both above and under the motor,and thus, if the lubricating oil supply passage is formed above the bearing, the required space from the motor to the rotating discover the motor must be increased, and this increases the height of the twisting unit, thereby reducing the rotational stability when the spindle shaft is rotated at high rotation speed.

It is thus a first object of the present invention to provide an individual-spindle-drive type multiple twister that enables a motor that directly drives a spindle shaft to be easily assembled despite the attractive force between a rotor and a stator and that enables increase of the driving power of the motor by increasing the magnetic force of the permanent magnet constituting the rotor, thereby improving twisting efficiency and, accordingly, productivity.

In addition, it is a second object of the present invention to provide an individual-spindle-drive type multiple twister wherein a motor with a permanent magnet constituting a rotor and having a high magnetic force can provide sufficient driving force, and wherein the spindle shaft can rotate stably at high rotation speed.

Furthermore, it is a third object of the present invention to provide an individual-spindle-drive type multiple twister that restrains the height of the twisting unit to enable the spindle shaft to rotate stably at the high rotation speed, and that enables a lubricating oil to be supplied reliably and simply to a bearing.

SUMMARY OF THE INVENTION

The present invention uses the following means to achieve these objects for an individual-spindle-drive type multiple twister. That is, the present invention relates to an individual-spindle-drive type multiple twister that uses a motor to directly rotate the spindle shaft of a twisting unit, wherein the spindle shaft is rotatably supported by a bearing at least in the lower portion of the motor, and wherein the distance between the lower end of a rotor that constitutes a permanent magnet fixed to the spindle shaft and the lower end of the spindle shaft is configured to be longer than the distance between the upper end of a stator fixed to the housing of the motor and the bearing in the lower portion of the motor.

In addition, the lower end of the spindle shaft is tapered by reducing its diameter.

In addition, the spindle shaft has formed therein a step portion that engages and locks onto the bearing in the lower portion of the motor when the motor is assembled.

In addition, the present invention provides an individual-spindle-drive type multiple twister that uses a motor to directly rotate the spindle shaft of a twisting unit, wherein the housing of the motor comprises a motor supporting portion having a stator fixed on its inner circumferential surface, an upper supporting member mounted at the upper end of the motor supporting portion and to support the spindle shaft via a bearing, and a lower supporting member mounted at the lower end of the motor supporting portion and to support the spindle shaft via a bearing, wherein the motor supporting portion comprises a non magnetic substance, and wherein the upper and lower supporting members comprise members having a higher rigidity than the motor supporting portion.

In addition, a fitting portion that fits the upper supporting member is formed at the upper end of the motor supporting portion so that the motor supporting portion and the upper supporting member are fitted together in such a way that the outer circumferential surface of the fitting portion contacts the inner circumferential surface of the upper supporting member.

In addition, the motor supporting portion comprises aluminum.

Furthermore, a rotating disc that rotates integrally with the spindle shaft is located above the motor, the twisting unit is supported under the motor, and vertical fins are formed on the outer circumferential surface of the motor supporting portion.

In addition, the present invention provides an individual-spindle-drive type multiple twister that uses a motor to directly rotate the spindle shaft of a twisting unit, wherein a bearing support portion for rotatably supporting the spindle shaft via a bearing is formed on the housing of the motor with a stator fixed thereto, wherein the bearing support portion has a lubricating oil supply port for externally supplying a lubricating oil to the bearing and a lubricating oil passage that guides the lubricating oil from the lubricating oil supply port to the bearing, and wherein the lubricating oil passage is located at the outer circumference of the bearing.

In addition, the lubricating oil passage has an inclined section that inclines in an upward direction, and an outlet for the lubricating oil passage that opens onto the inner circumferential surface of the bearing support portion is located above the bearing, and a protruding portion that protrudes inward in the radial direction is formed above a passage outlet in the bearing support portion.

Finally, the present invention provides an individual-spindle-drive type multiple twister that uses a motor to directly rotate the spindle shaft of a twisting unit, wherein the housing of the motor is configured by fitting together a motor supporting portion with a stator fixed thereto and a bearing support portion that rotatably supports the spindle shaft via a bearing which are fabricated separately from the motor supporting portion, and wherein a lubricating oil passage that penetrates the side wall of the motor supporting portion and a lubricating oil passage that penetrates the side wall of the bearing support portion are formed in the fitting portion at the motor support portion and the bearing support portion, and allow both lubricating oil passages to communicate with each other.

DETAILED DESCRIPTION OF THE PREFERRED EMBODIMENTS

Figure 1:
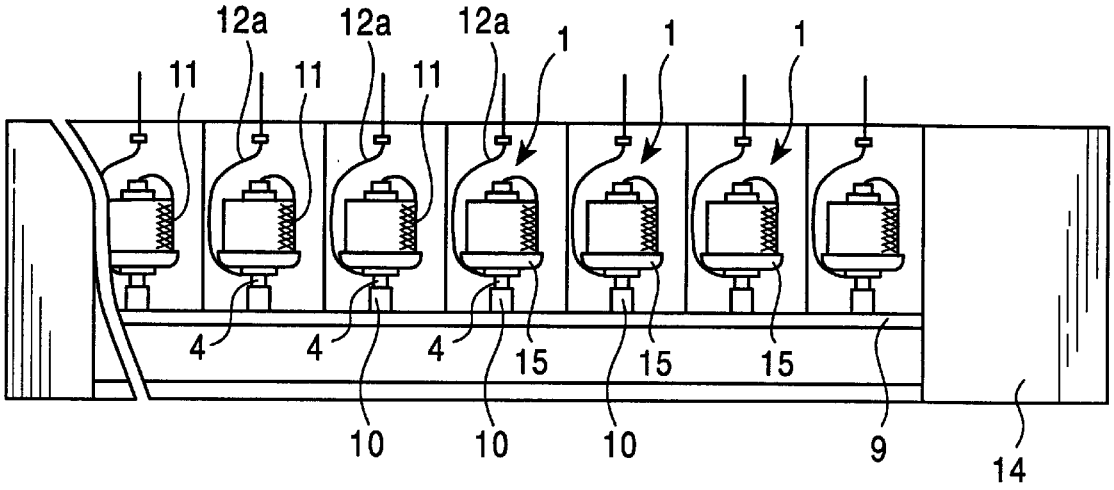
FIG. 1 is a general view showing an individual-spindle-drive type multiple twister according to the present invention, which comprises a large number of twisting units installed in a line.

A schematic configuration of an individual-spindle-drive type multiple twister according to the present invention will now be described. In FIG. 1, a large number of twisting units 1 for an individual-spindle-drive type multiple twister are provided in a line. A spindle shaft 4 provided for each twisting unit 1 and a rotating disc 15 located at the upper end of the spindle shaft 4 are configured to rotate integrally, and the spindle shaft 4 is rotated by a drive motor 10 provided in each of the twisting units 1, thereby rotating the rotating disc 15 integrally. The rotating disc 15 is located above the drive motor 10, and the twisting unit 1 is supported on a frame 9 under the drive motor 10.

The rotating disc 15 is rotated via the spindle shaft 4 to twist a yarn 12*a* that is drawn out from a supply package 11 disposed immovably above the rotating disc 15. A controlling portion 14 controls the drive conditions of each individual-spindle-drive type multiple twister.

The twisting unit 1 according to this embodiment is adapted for spun yarn to twist spun yarn formed by spinning short fibers into a single long yarn.

Figure 2:
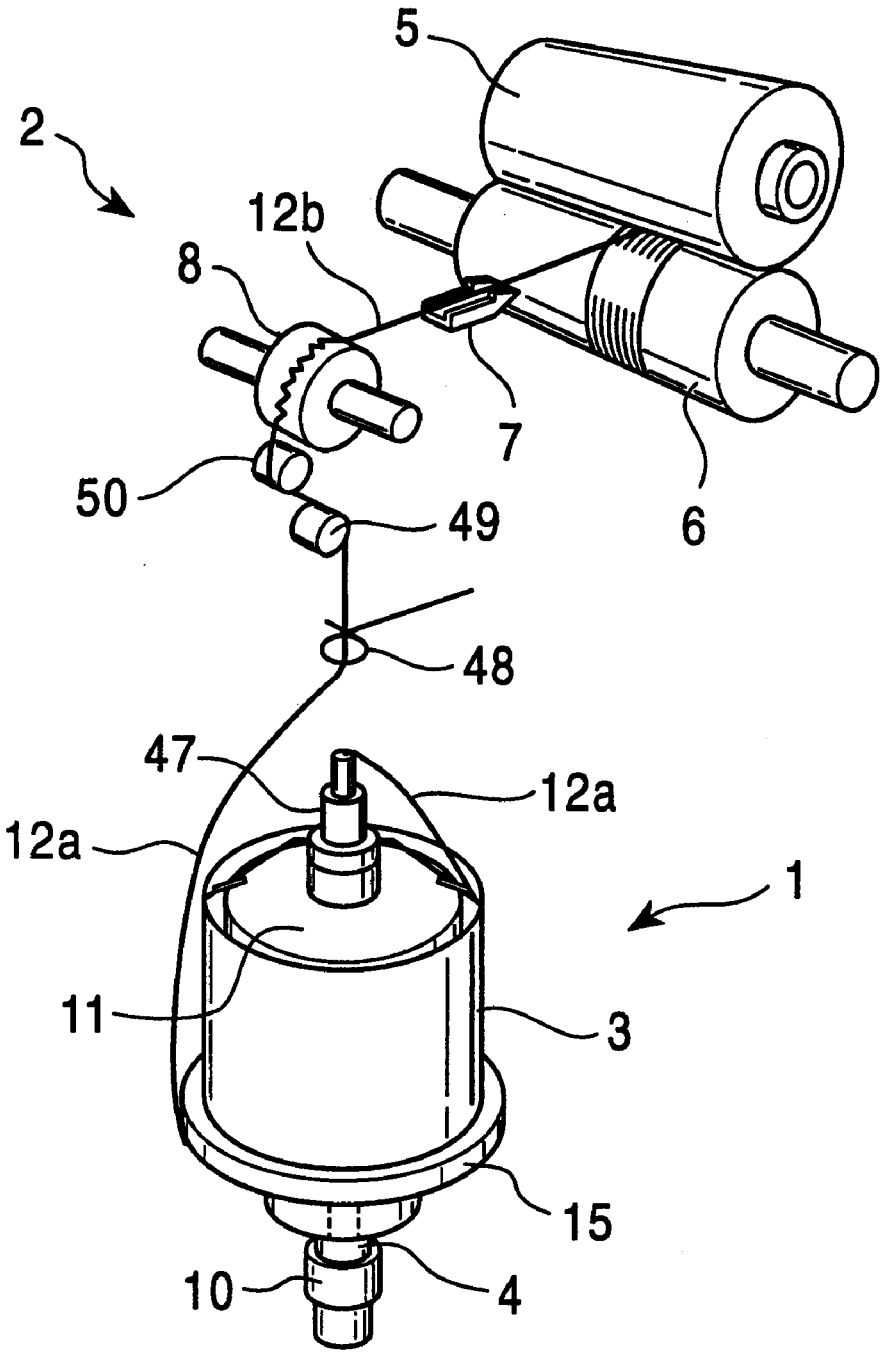
FIG. 2 is a perspective view showing an individual-spindle-drive type multiple twister for a spun yarn.
Figure 3:
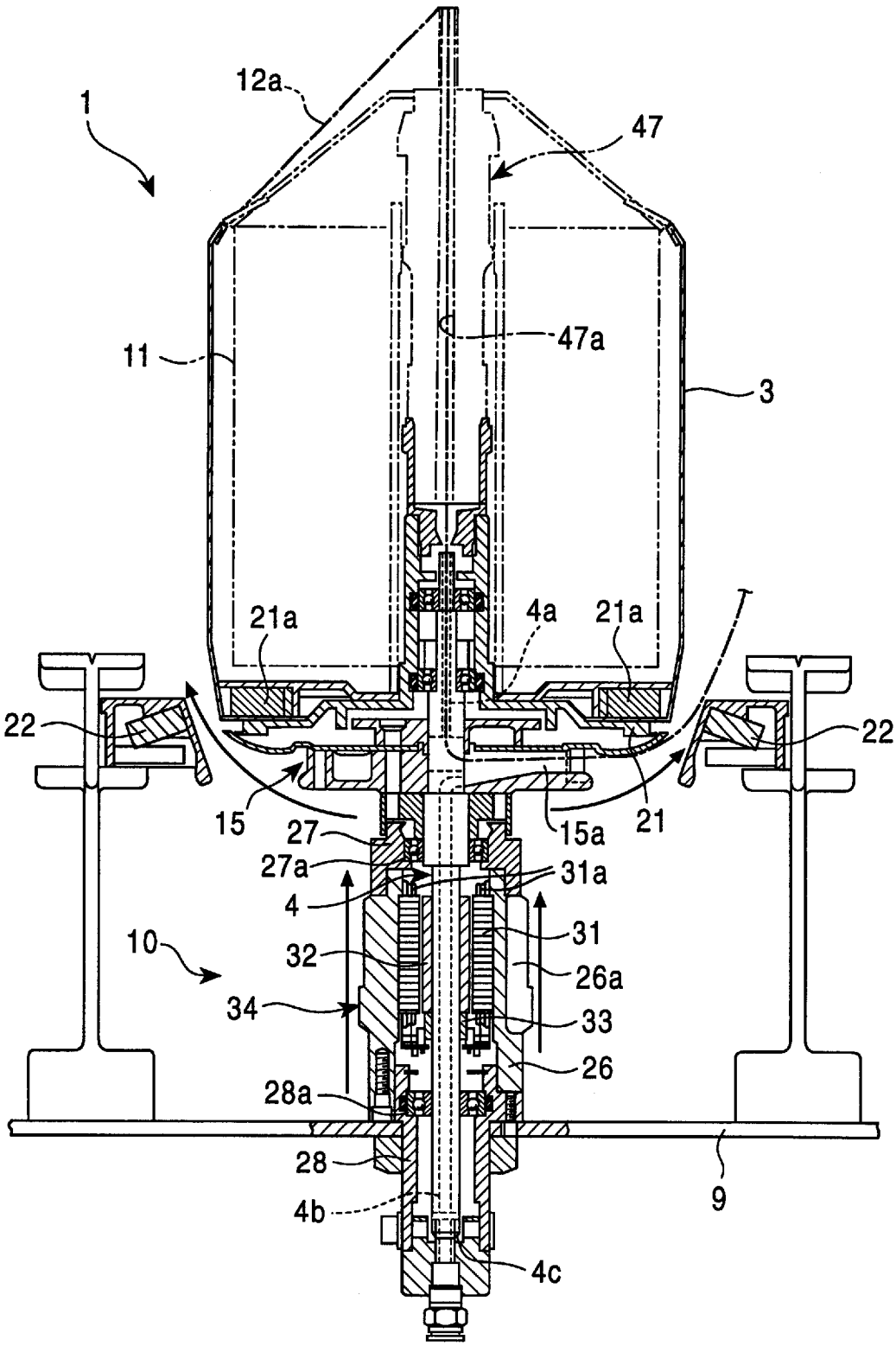
FIG. 3 is a side sectional view showing a twisting unit of an individual-spindle-drive type multiple twister for a spun yarn.

In FIGS. 2 and 3, the supply package 11 of the twisting unit 1 is placed on a stationary plate 21 located above the rotating disc 15, and the stationary plate 21 is supported by inserting it through the upper part of the spindle shaft 4. A stationary magnet 21*a* is installed inside the stationary plate 21 so that the stationary plate 21 is kept stationary by the attractive force between the stationary magnetic 21*a* and an attracting magnet 22 located on the outer circumference of the stationary plate 21 some distance away. In addition, the outer circumference of the supply package 11 is covered with a cheese cover 3 integrated with the stationary plate 21.

The yarn 12*a* drawn out from the supply package 11 enters a tension apparatus 47 from above, where the yarn 12*a* is subjected to a predetermined tension, and the yarn 12*a* is then guided in the outer circumferential direction from the center of the rotating disc 15 through a guide portion 15*a*, and the yarn 12*a* then extends from the outer circumference of the rotating disc 15 to reach a balloon guide 48 in the upper part of the twisting unit 1.

The yarn 12*a* extended from the outer circumferential surface of the rotating disc 15 is ballooned as the rotating disc 15 driven by the drive motor 10 rotates at high speeds, and while the rotating disc 15 is making a single rotation, the yarn 12*a* is twisted twice, that is, it is twisted once between the tension apparatus 47 and the rotating disc 15, and once between the rotating disc 15 and the balloon guide 48.

In this manner, the individual-spindle-drive type multiple twister is configured, for example, as a double twisting machine that twists the yarn twice while the rotating disc 15 is making a single rotation.

A winding apparatus 2 is disposed above the twisting unit 1 and configured to wind a twisted yarn 12*b* twisted by the twisting unit 1. The twisted yarn 12*b* extending upward from the balloon guide 48 passes through guide rollers 49 and 50, and a feed roller 8 to reach a traverse guide 7. Upon reaching the traverse guide 7, the twisted yarn 12*b* is traversed by the traverse guide 7 while being wounded around a winding package 5 that contacts a drum 6 and rotes.

Next, the twisting unit 1 will be described with reference to FIGS. 3 to 10. First, as shown in FIG. 3, the yarn 12*a* drawn out from the supply package 11 enters a tension hole 47*a* of the tension apparatus 47 through its upper end, and then enters a guide hole 4*a* of the spindle shaft 4 located under the tension apparatus 47. The guide hole 4*a* is in communication with the guide portion 15*a* of the rotating disc 15 at its lower end, and the yarn 12*a* that has entered the guide yarn 4*a* extends to the exterior through the guide portion 15*a*.

In addition, an air hole 4*b* in communication with the guide portion 15*a* is formed from the lower end of the spindle shaft 4 so that air can be supplied from the lower end of the air hole 4*b*. The air flows from the center of the guide portion 15*a* toward its outer circumference, so the yarn 12*a* that has entered the tension hole 47*a* of the tension apparatus 47 is automatically guided to the outer circumferential end of the guide portion 15*a* of the rotating disc 15.

Figure 4:
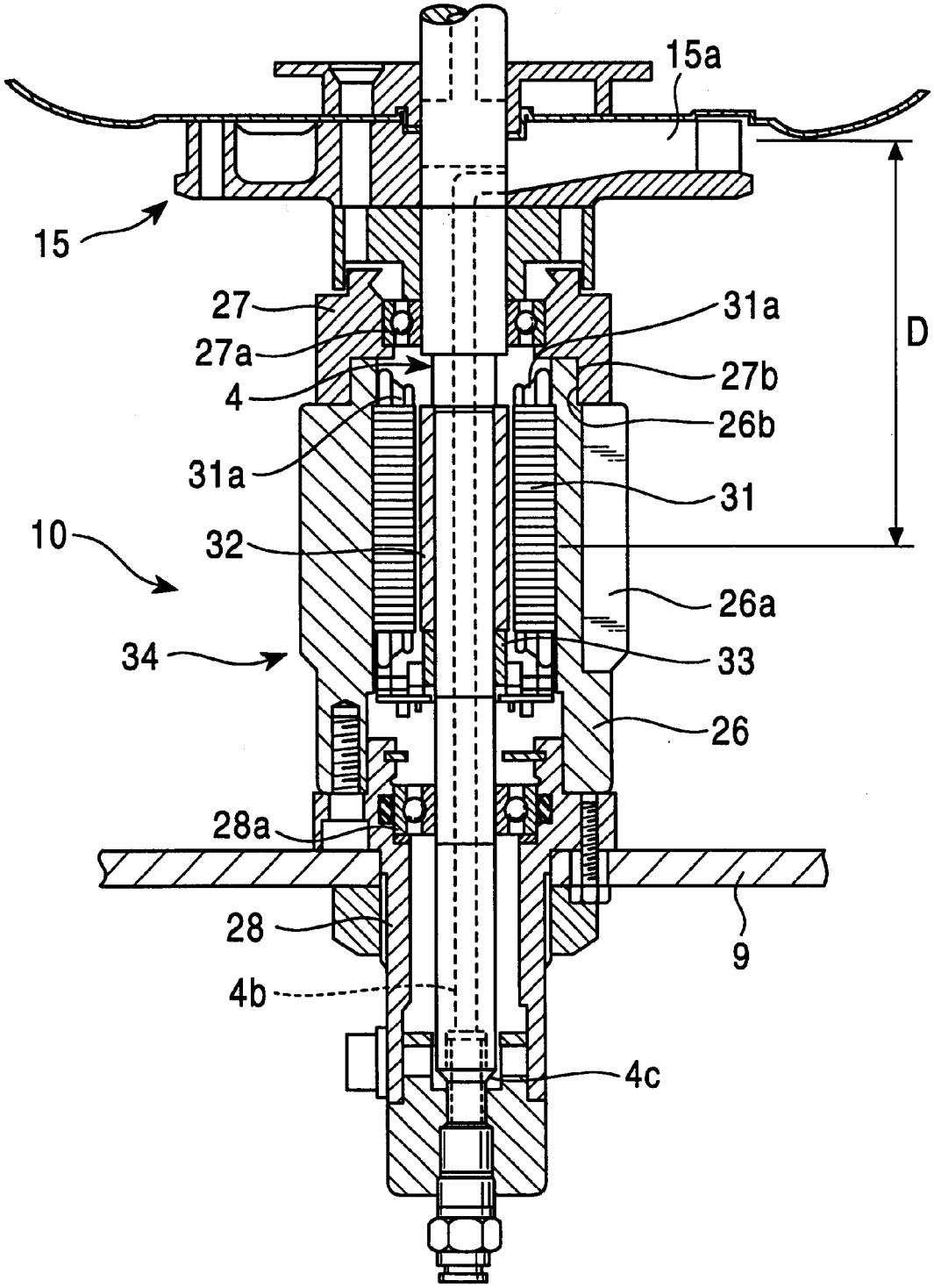
FIG. 4 is a side sectional view showing a drive motor portion of the twisting unit in FIG. 3.

As shown in FIG. 4, the drive motor 10 is disposed under the rotating disc 15 to rotationally drive the spindle shaft 4. The drive motor 10 is composed of a rotor magnet 32 installed on the outer circumference of the spindle shaft 4, a stator coil 31 located on the outer circumferential surface of the rotor magnet 32 and opposite thereto, and a motor housing 34 that houses the drive motor 10, and so on.

The motor housing 34 is composed of a motor supporting portion 26 having the stator coil 31 fixed to its inner circumferential surface, an upper supporting member 27 mounted at the upper end of the motor supporting portion 26 to rotatably support the spindle shaft 4 via a bearing 27*a*, and a lower supporting member 28 mounted at the lower end of the motor supporting portion 26 to rotatably support the spindle shaft 4 via a bearing 28*a*.

The motor supporting portion 26 is, for example, composed aluminum or another a non-magnetic material that has a high thermal conductivity, and the upper supporting member 27 and the lower supporting member 28 are, for example, composed of iron or another material that has high rigidity. In addition, the lower supporting member 28 at the upper end of the motor housing 34 is mounted on the frame 9, thereby supporting the twisting unit 1 on the frame 9.

The rotor magnet 32 of the drive motor 10 is composed of a rare earth magnet as a permanent magnet having a very high magnetic force such as a neodyum magnet, thereby enabling the drive motor 10 to be compact and provide a high driving force.

In addition, the stator coil 31 is configured as a core coil having an iron core 31*a*.

Furthermore, a detecting magnet 33 is fixed to the spindle shaft 4 under the rotor magnet 32 to detect the rotation speed of the spindle shaft 4, and the detecting magnet 33 is composed of such as plastic magnet as a permanent magnet that does not have a strong magnetic force (its magnetic force is weaker than that of the rotor magnet 32). A magnetic sensor is located opposite to the detecting magnet 33.

A fitting portion 27*b*, in which the motor supporting portion 26 is fitted, is formed along the inner circumferential surface of the lower end of the upper supporting member 27 constituting the motor housing 34, and a fitting portion 26*b* configured to have a smaller diameter than the fitting portion 27*b* is formed at the upper end of the motor supporting portion 26.

By fitting the fitting portion 26*b* of the motor supporting portion 26 and the fitting portion 27*b* of the upper supporting member 27 together, both supporting portions 26 and 27 are coupled together in such a way that the outer circumferential surface of the fitting portion 26*b* and the inner circumferential surface of the fitting portion 27*b* contact each other. By coupling both supporting portions together in this manner, the upper supporting portion 27 is prevented from interfering with the inner circumferential surface of the motor supporting portion 26 to enable the stator coil 31 fixed to the inner circumferential surface of the motor supporting portion 26 to be located near the upper end of the motor supporting portion 26.

Thus, in the drive motor 10, the motor portion composed of the stator coil 31 and the rotor magnet 32 can be located as high up as possible, thereby reducing the interval D (shown in FIG. 4) between the upper rotating disc 15 and the motor portion.

Since the interval between the motor portion of the drive motor 10 that rotates the spindle shaft 4 and the rotating disc 15 that rotates integrally with the spindle shaft 4 is reduced in this manner, even if a drive motor 10 having a high driving force rotates the spindle shaft 4 at high speeds, deflections of the spindle shaft 4 can be prevented, and thus the spindle shaft 4 will rotate stably at high speeds.

In addition, the fitting portions of the motor supporting portion 26 and the lower supporting member 28 are fitted together so that the inner circumferential surface of the motor supporting portion 26 contacts the outer circumferential surface of the lower supporting member 28. The lower supporting member 28 is mounted on the frame 9 by using a bolt to tighten the lower supporting member 28 onto the frame 9 at the outer circumferential side of the fitted portion between the motor supporting portion 26 and the lower supporting member 28.

In addition, the upper supporting member 27 that supports the spindle shaft 4 via the bearing 27*a* and the lower supporting member 28 that supports the spindle shaft 4 via the bearing 28*a* are composed of a member made of iron or some other material having a higher rigidity than aluminum that constitutes the motor supporting portion 26. Consequently, the upper supporting member 27 and the lower supporting member 28 can firmly support the spindle shaft 4, and thereby ensure high durability. Thus, even if the drive motor 10 rotates the spindle shaft 4 at high speeds, the deflection of the spindle shaft 4 can be prevented, and the spindle shaft 4 will rotate stably at high speeds, thereby ensuring stable fast rotations even after long periods of continuous operations.

Figure 5:
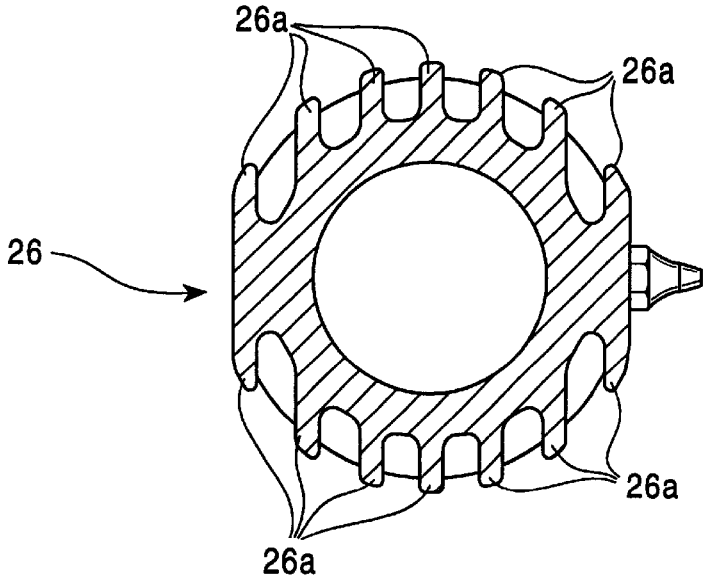
FIG. 5 is a top sectional view showing a motor supporting portion constituting a motor housing of the drive motor.
Figure 6:
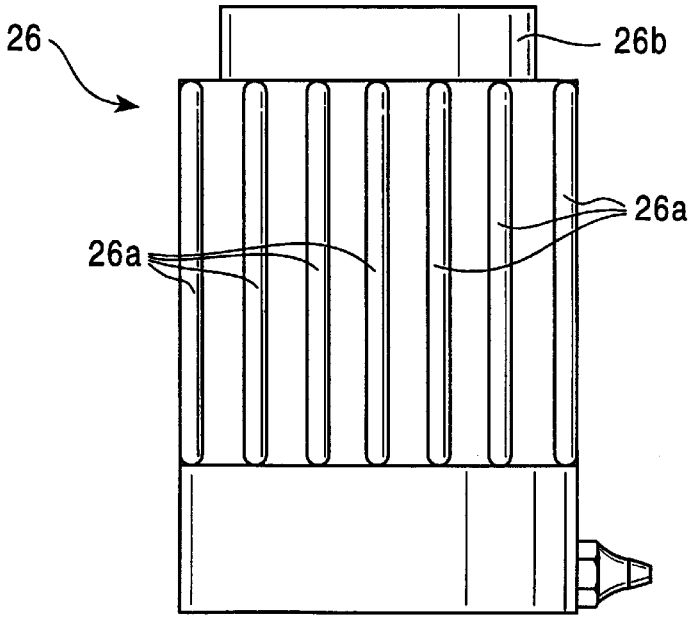
FIG. 6 is a top sectional view showing a motor supporting portion constituting a motor housing of the drive motor

As shown in FIGS. 5 and 6, a plurality of fins 26*a*, 26*a*, . . . protruding outward are formed on the outer circumference of the motor supporting portion 26 constituting the motor housing 34, and the fins 26*a*, 26*a*, . . . are provided in the vertical direction so as to efficiently remove heat generated due to the driving by the drive motor 10. That is, when the drive motor 10 drives the spindle shaft 4 to rotate the rotating disc 15, the air flows from the center of the rotating disc 15 towards the outside of the rotating disc 15 due to the rotational movement of the rotating disc 15. Due to this flow, the air flows upward from under the rotating disc 15 and along the drive motor 10 (see the arrow in FIG. 3).

When the air blow caused by the rotation of the rotating disc 15 passes through the motor housing 34 of the drive motor 10, it removes heat from the outer circumferential surface of the motor housing 34 to cool the drive motor 10.

Because the fins 26*a*, 26*a*, . . . are formed on the motor supporting portion 26 of the motor housing 34 with the motor portion of the drive motor 10 installed inside, the outer circumferential surface of the motor supporting portion 26 is increased, and as a result, the air flow efficiently cools the motor and provides a high cooling effect.

Moreover, because the fins 26*a*, 26*a*, . . . are provided in the vertical direction, the air flows along the side walls of each of the fins 26*a* (that is, along the grooves between the fins 26*a*), and this enables heat to be efficiently removed from the overall outer circumferential surface of the fin 26*a*.

Furthermore, since the motor supporting portion 26 with the fins 26*a* formed thereon is composed of aluminum having a high thermal conductivity, the motor supporting portion 26 appropriately radiates heat to encourage efficient cooling. If, for example, the drive motor 10 constitutes a powerful motor that generates much heat, the motor housing 34 can be configured to have a cooling structure providing a high cooling effect as described above, thereby enabling the drive motor 10 to be efficiently cooled and ensuring sufficient cooling throughout the system. The efficient cooling system in turn enables the drive motor 10 to provide sufficient drive power to rotationally drive the spindle shaft 4 efficiently.

In addition, because the motor supporting portion 26 of the motor housing 34 is composed of aluminum, which is a non magnetic substance, no magnetic interference occurs between the motor supporting portion 26 and the motor portion installed inside it. This prevents the drive power from being reduced. Consequently, the drive motor 10 can provide sufficient power to drive the rotating spindle shaft 4 efficiently.

Figure 7:
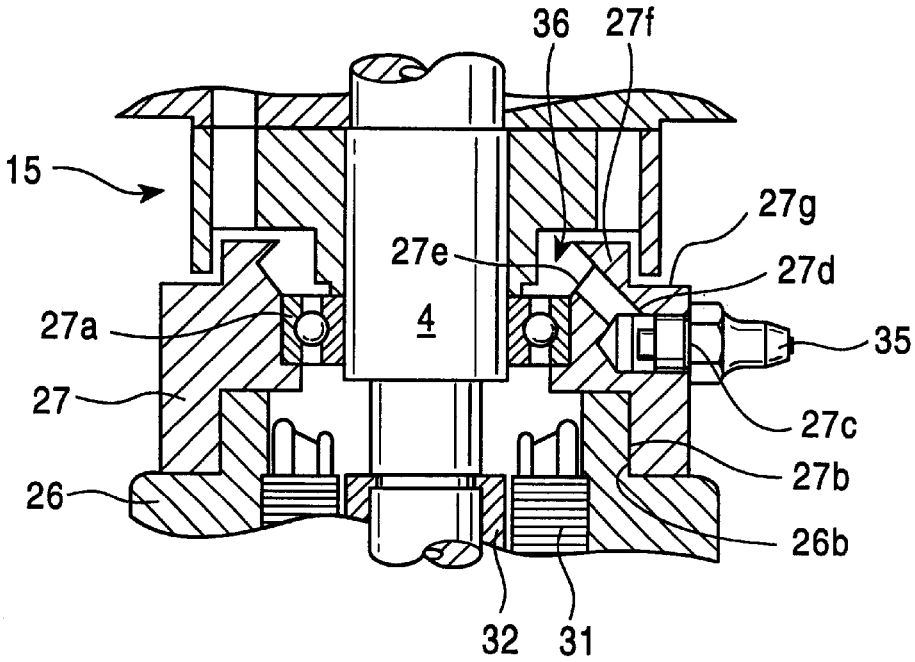
FIG. 7 is a side sectional view showing a portion for supplying a lubricating oil to a bearing of an upper supporting member.

In addition, a lubricating oil such as grease is supplied to the bearing 27*a* of the upper supporting member 27 and the bearing 28*a* of the lower supporting member 28 that support the spindle shaft 4 driven by the drive motor 10. The oil is supplied via a lubricating oil supply port formed in the side of the motor housing 34 of the rotor magnet 32. That is, as shown in FIG. 7, to supply a lubricating oil to the bearing 27*a* of the upper supporting member 27, a lubricating oil passage 27*d* is formed so as to penetrate the upper supporting member 27 for the motor housing 34. The lubricating oil is supplied through the lubricating oil passage 27*d* to the bearing 27*a* from an upper lubricating oil supply port 27*c* formed having the lubricating oil passage 27*d* open onto the outer side of the upper supporting member 27.

The upper lubricating oil supply port 27*c* is located laterally in the outer circumferential surface of the bearing 27*a*, that is, radially outside the bearing 27*a*, and the lubricating oil passage 27*d* is disposed to extend from the upper lubricating oil supply port 27*c* inward in a roughly horizontal direction up to a midway position, and the lubricating oil passage 27*d* then inclines inward and upward to a passage outlet 27*e* that constitutes the end of the lubricating oil passage 27*d*. The passage outlet 27*e* opens onto the inner circumferential surface of the upper supporting member 27 and is located above the bearing 27*a*. Above the passage outlet 27*e*, the inner circumferential surface of the upper supporting member 27 protrudes inward beyond the passage outlet 27*e* to form a protruding portion 27*f*. The upper lubricating oil supply port 27*c* may be located slightly below the outer circumferential surface of the bearing 27*a*.

Then, lubricating oil is supplied from the upper lubricating oil supply port 27*c* through the lubricating oil passage 27*d* to the bearing 27*a*. In this case, since the passage outlet 27*e* is located above the bearing 27*a*, the lubricating oil supplied through the passage outlet 27*e* into a space 36 inside the upper supporting member 27 is reliably supplied to the lower bearing 27*a*. In addition, the protruding portion 27*f* protruding inward is formed above the passage outlet 27*e* of the lubricating oil passage 27*d*, so the lubricating oil supplied in the space 36 through the passage outlet 27*e* is prevented from traveling upward and instead travels downward so as to be more reliably supplied to the lower bearing 27*a*. By fitting a nipple 35 in the lubricating oil passage 27*d* through the upper lubricating oil supply port 27*c*, the upper lubricating oil supply port 27*c* is constantly occluded except when the lubricating oil is being supplied, thereby preventing the lubricating oil from leaking to the exterior through the upper lubricating oil supply port 27*c*.

In addition, the upper lubricating oil supply port 27*c* is located along the outer circumferential surface of the bearing 27*a*. Consequently, a notch 27*g* can be formed by cutting out the outer circumferential surface of the upper end of the upper supporting member 27 that is located above the upper lubricating oil supply port 27*c*. The rotating disc 15 is located down low so that the outer circumferential surface of the lower end of the rotating disc 15 is located at the notch 27*g*. Locating the rotating disc 15 down low in this manner reduces the interval D between the rotating disc 15 and the motor portion installed inside the motor supporting portion 26, thereby enabling the height of the twisting unit 1 to be controlled. This configuration prevents the spindle shaft 4 from deflecting, and thus enables it to rotate stably at high speeds.

Figure 8:
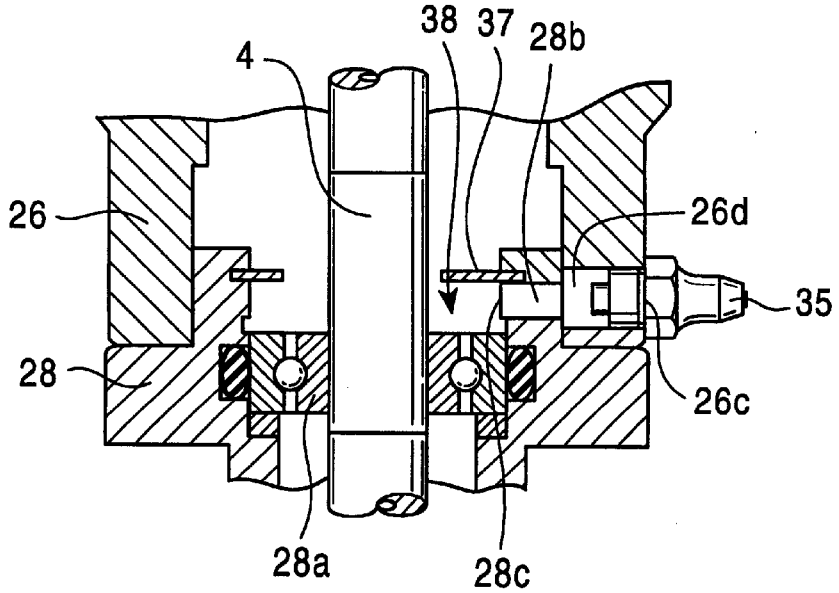
FIG. 8 is a side sectional view showing a portion for supplying a lubricating oil to a bearing of a lower supporting member.

In addition, as shown in FIG. 8, to supply the lubricating oil to the bearing 28*a* of the lower supporting member 28, the fitted portion between the motor supporting portion 26 and the lower supporting member 28 forms a lubricating oil passage 26*d* that penetrates the side wall of the motor supporting portion 26 and a lubricating oil passage 28*b* that penetrates the side wall of the lower supporting member 28. The lubricating oil passages 26*d* and 28*b* are connected with each other, and the lubricating oil passage 26*d* opens onto the outer circumferential surface of the motor supporting portion 26 as a lubricating oil supply port 26*c*. The lower lubricating oil supply port 26*c* is located laterally in the outer circumferential surface of the bearing 28*a*, that is, radially outside the bearing 28*a*. Then, the lubricating oil is supplied from the lower lubricating oil supply port 26*c* through the lubricating oil passages 26*d* and 28*b* to the bearing 28*a*.

A passage outlet 28*c* formed by opening the lubricating oil passage 28*b* of the lower supporting member 28 onto the inner circumferential surface of the lower supporting member 28 is located above the bearing 28*a*, and a seal member 37 that protrudes inward to occlude the gap extending from the inner side of the lower supporting member 28 to the spindle shaft 4 is disposed above the passage outlet 28*c*. The seal member 37 prevents the lubricating oil supplied through the passage outlet 28*c* into the space 38 inside the lower supporting member 28 from being forced up beyond the seal member 37, thereby allowing the lubricating oil to be reliably supplied to the bearing 28*a* located under the space 38. In addition, by fitting the nipple 35 in the lubricating oil passage 26*d* through the lower lubricating oil supply port 26*c*, the lower lubricating oil supply port 26*c* is constantly occluded except when the lubricating oil is being supplied, thereby preventing the lubricating oil from leaking to the exterior through the lower lubricating oil supply port 26*c*.

As described above, the lubricating oil is supplied to the bearing 27*a* of the upper supporting member 27 and the bearing 28*a* of the lower supporting members 28 through the upper lubricating oil supply port 27*c* and the lower lubricating oil supply port 26*c*, respectively. This configuration enables the lubricating oil to be externally supplied while the spindle shaft 4 is being supported by the bearings 27*a* and 28*a*, thereby simplifying the lubricating oil supply operation and enabling the individual-spindle-drive type multiple twister to be made more compact. In addition, because the lubricating oil supply port 27*c* through which the lubricating oil is externally supplied is formed in the side of the upper supporting member 27 so as to be located along the outer circumferential surface of the bearing 27*a*, the lubricating oil can be easily supplied to the bearing 27*a* while controlling the height of the twisting unit 1.

Moreover, because the passage outlet 27*e* of the lubricating oil passage 27*d* in the upper supporting member 27 is located above the bearing 27*a*, and because the protruding portion 27*f* that protrudes inward is formed above the passage outlet 27*e*, the lubricating oil can be efficiently and reliably supplied to the bearing 27*a*. Likewise, because the passage outlet 28*c* of the lubricating oil passage 28*b* in the lower supporting member 28 is located above the bearing 28*a*, and because the seal member 37 protruding inward is provided above the passage outlet 28*c*, the lubricating oil can be efficiently and reliably supplied to the bearing 28*a*.

In addition, to supply the lubricating oil to the bearing 28*a* of the lower supporting member 28, the lubricating oil supply port 26*c* and the lubricating oil passages 26*d* and 28*b* are formed in the fitted portion between the motor supporting portion 26, and the lower supporting portion 28, and the lubricating oil passages 26*d* and 28*b* are in communication with each other. Thus, compared to, for example, a configuration in which the lubricating oil supply port and the lubricating oil passage are formed in the lower supporting member 28 to supply the lubricating oil from above the bearing 28*a*, the fitted portion between the motor supporting portion 26 and the lower supporting portion 28 can be located closer to the bearing 28*a*, thereby reducing the height of the motor 10. This configuration enables the lubricating oil to be easily supplied to the bearing 28*a* while controlling the height of the twisting unit 1.

As described above, the drive motor 10 is configured as a DC brushless motor capable of driving a spindle at high rotation speeds. The rotor magnet 32, which composes a permanent magnet having a high magnetic force, is fixed to the spindle shaft 4, and the stator coil 31 including the iron core 31*a* is located on the outer circumferential surface of the rotor magnet 32, and the stator coil 31 and the rotor magnet 32 are housed within the motor housing 34.

To assemble the drive motor 10, the motor housing 34 is configured by mounting the upper supporting member 27 and the lower supporting member 28 on the motor supporting portion 26, and fixing the stator coil 31 to the inner circumference of the motor supporting portion 26. The spindle shaft 4 with the rotor magnet 32 fixed to its outer circumferential surface is then inserted into the motor housing 34 from above so as to fit in the bearing 27*a* of the upper supporting member 27, and then, the spindle shaft 4 is further inserted so as to fit in the bearing 28*a* of the lower supporting member 28 and is then further inserted down to a position where the stator coil 31 and the rotor magnet 32 are opposed to each other.

Figure 9:
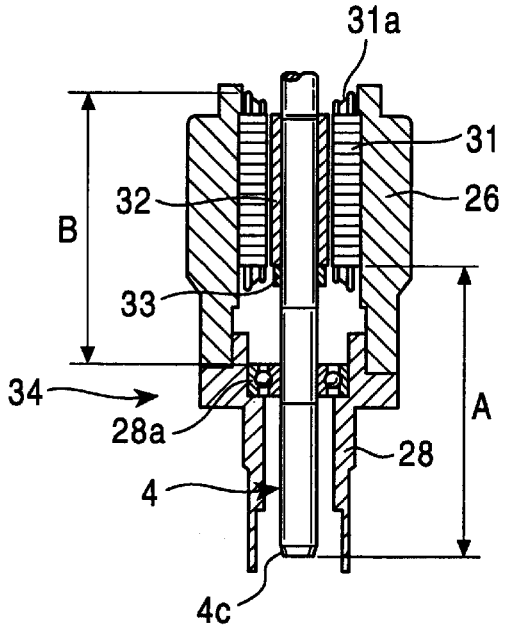
FIG. 9 is a side view showing the relationship between the distance from the lower end of a rotor magnet to the lower end of a spindle shaft and the distance from the upper end of a stator coil to a bearing of the lower supporting member.

Once the drive motor 10 is assembled by inserting the spindle shaft 4 into the motor housing 34 in the above manner, the distance A between the lower end of the rotor magnet 32 fixed to the spindle shaft 4 and the lower end of the spindle shaft 4 is larger than the distance B between the upper end of the iron coil 31*a* of the stator coil 31 fixed to the motor supporting portion 26 and the bearing 28*a* of the lower supporting member 28 located under the motor supporting portion 26 (under the motor), as shown in FIG. 9.

Figure 10:
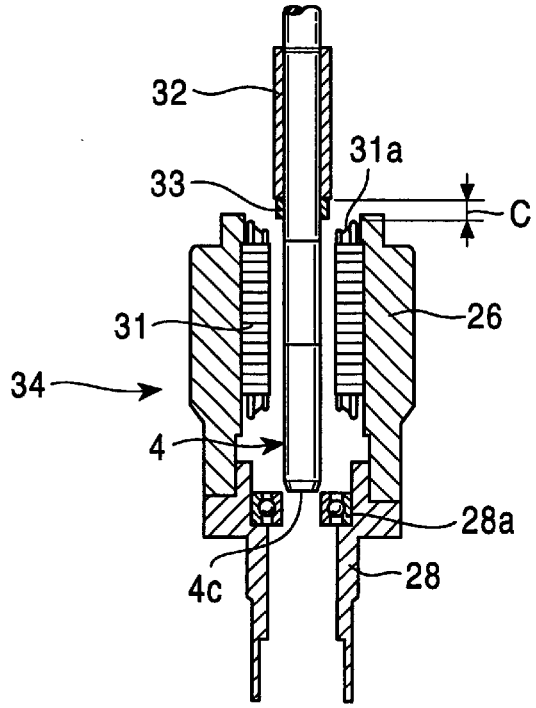
FIG. 10 is a side view showing a state in which a spindle shaft is inserted into the motor housing down to a position at which it fits the bearing of the lower supporting member.

Since distance A is larger than distance B, when the spindle shaft 4 is inserted into the motor housing 34 until it reaches a position where it is fitted into the bearing 28*a* of the lower supporting member 28 as shown in FIG. 10, the lower end of the rotor magnet 32 separates upward from the upper end of the iron core 31*a* of the stator coil 31 by a dimension C to prevent a strong attractive force from being generated between the rotor magnet 32 and the stator coil 31. Thus, until the spindle shaft 4 inserted from the upper end of the motor housing 34 is fitted into the bearing 28*a* of the lower supporting portion 28, the position where the spindle shaft 4 is inserted is not affected by the attractive force generated between the rotor magnet 32 and the stator coil 31, thereby enabling the spindle shaft 4 to be easily fitted into the bearing 28*a* of the lower supporting member 28.

In the configuration shown in FIG. 10, because the detecting magnet 33 provided under the rotor magnet 32 to detect the rotation speed of the spindle shaft 4 is also located at the upper end of the iron core 31*a* of the stator coil 31, a strong attractive force is not generated between the detecting magnet 33 and the stator coil 31. In addition, because the magnet force of the detecting magnet 33 is relatively weak, a strong attractive force is not generated between the detecting magnet 33 and the stator coil 31 even if they are opposed to each other, thereby preventing the insertion point of the spindle shaft 4 from being affected.

That is, since the detecting magnet 33, having a weaker magnetic force than the rotor magnet 32, is provided under the rotor magnet 32, a using amount of the expensive rotor magnet 32 can be suppressed to the utmost, and the wiring from the magnetic sensor can be simplified. In addition, during insertion of the spindle shaft 4 from above, the spindle shaft 4 is not significantly affected by the magnetic force generated between the detecting magnet 33 and the iron core 31*a*, thereby enabling the length of the spindle shaft 4 to be minimized.

After being fitted into the bearing 28*a* of the lower supporting member 28, the spindle shaft 4 is further inserted down to a position where the rotor magnet 32 and the stator coil 31 are opposed to each other. In this position, the rotor magnet 32 is located close to the stator coil 31 to effect a strong attractive force between them. Since, however, the spindle shaft 4 is supported by the bearing 27*a* of the upper supporting member 27 and the bearing 28*a* of the lower supporting member 28, the rotor magnet 32 and the stator coil 31 are prevented from adhering to each other, and so the spindle shaft 4 can be inserted smoothly.

In addition, the tip 4*c* of the spindle shaft 4 has a tapered diameter so that when inserted into the motor housing 34, the spindle shaft 4 can be fitted easily into the bearing 28*a* of the lower supporting member 28. Thus the spindle shaft 4 can be fitted into the bearing 28*a* more easily.

Next, as another embodiment of the twisting unit 1, a twisting unit for filament yarns that twists a filament yarn composed of long fibers such as silk or chemical fibers will be explained with reference to FIGS. 11 to 18.

Figure 11:
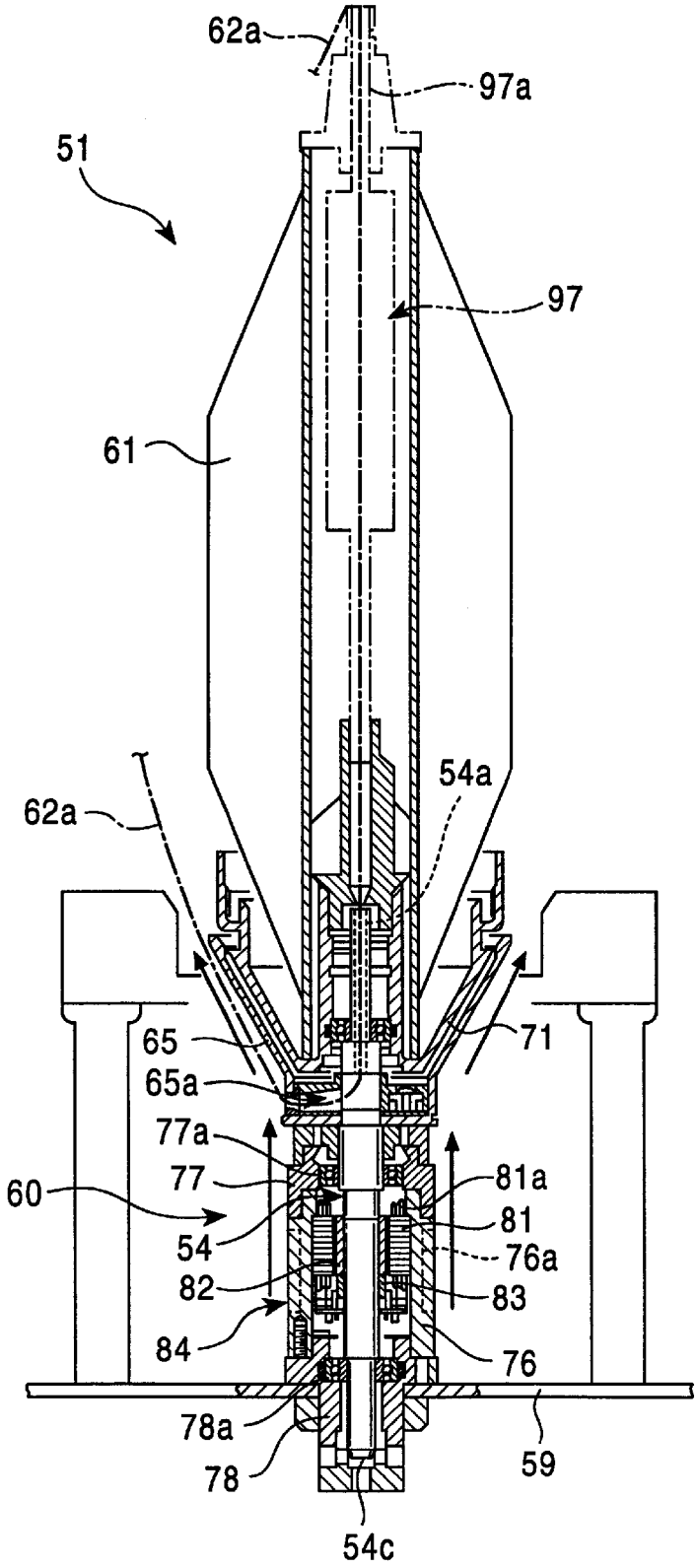
FIG. 11 is a side sectional view showing a twisting unit of an individual-spindle-drive type multiple twister for a filament yarn.

As in the above twisting unit 1, the supply package 61 of a twisting unit 51, as shown in FIG. 11, is placed on a stationary plate 71 stationarily located above a rotating disc 65, and the stationary plate 71 is supported by rotatably fitting it onto the top of a spindle shaft 54.

A yarn 62*a* drawn out from the supply package 61 of the twisting unit 51 enters a tension hole 97*a* in a tension apparatus 97 through its upper end and then enters a guide hole 54*a* in the spindle shaft 54 located under the tension apparatus 97. The guide hole 54*a* is in communication with a guide portion 65*a* of the rotating disc 65 at its lower end, and the yarn 62*a* which has entered the guide yarn 54*a* extends to the exterior through the guide portion 65*a*.

Figure 12:
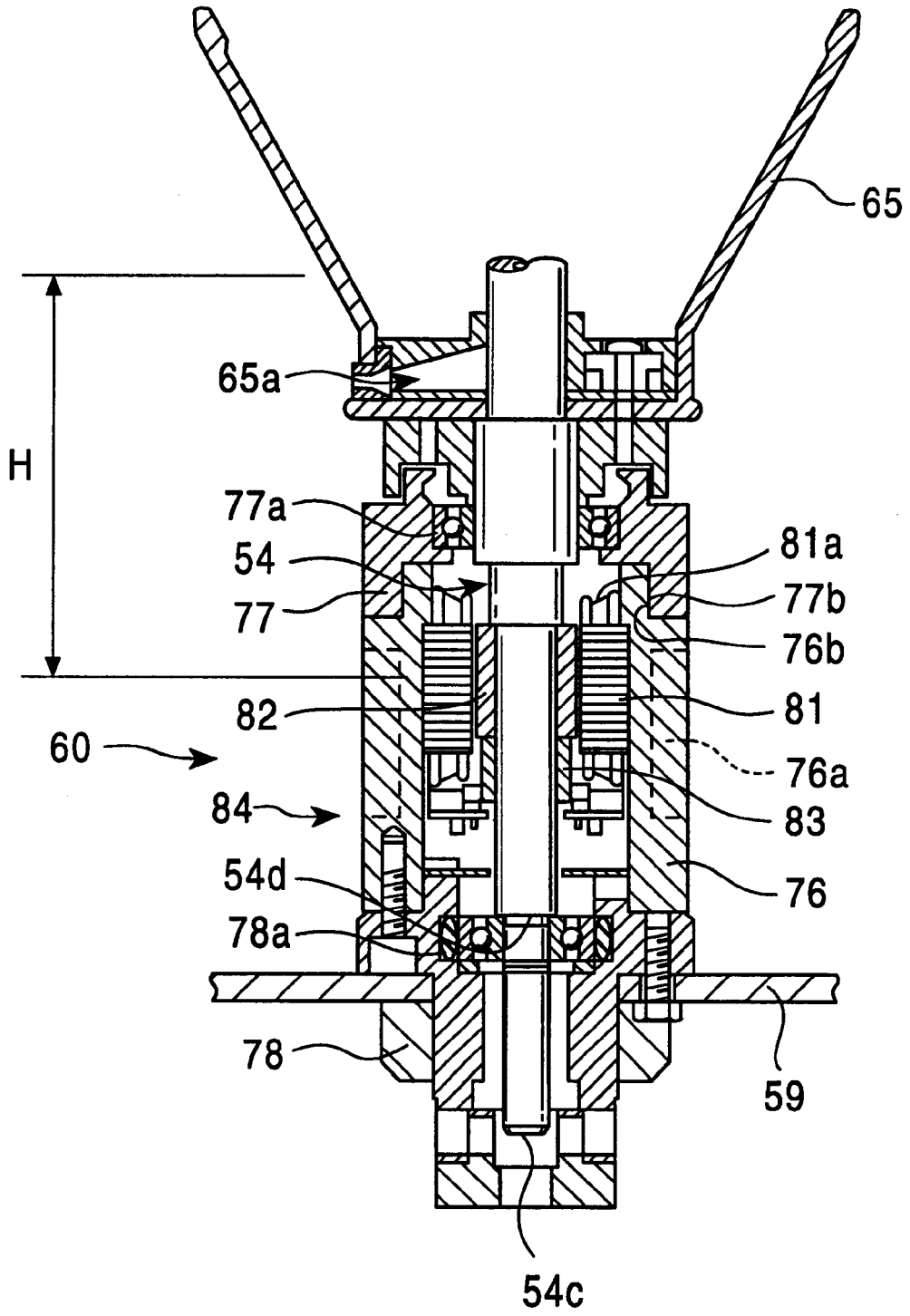
FIG. 12 is a side sectional view showing a drive motor portion of the twisting unit in FIG. 11.

As shown in FIG. 12, a drive motor 60 is disposed under the rotating disc 65 to rotate the spindle shaft 54. The drive motor 60 is composed of a rotor magnet 82 installed on the outer circumference of the spindle shaft 54, a stator coil 81 located on the outer circumferential surface of the rotor magnet 82 and opposite thereto, and a motor housing 84 that houses the drive motor 60, and so on. The motor housing 84 is composed of a motor supporting portion 76 having the stator coil 81 fixed to its inner circumferential surface, an upper supporting member 77 mounted at the upper end of the motor supporting portion 76 to rotatably support the spindle shaft 54 via a bearing 77*a*, and a lower supporting member 78 mounted at the lower end of the motor supporting portion 76 to rotatably support the spindle shaft 54 via a bearing 78*a*. The motor supporting portion 76 is composed of a non magnetic material having high thermal conductivity such as aluminum, and the upper supporting member 77 and the lower supporting member 78 are composed a rigid material such as iron. In addition, the lower supporting member 78 at the lower end of the motor housing 84 is mounted on the frame 59, thereby supporting the twisting unit 51 on the frame 59.

The rotor magnet 82 of the drive motor 60 is composed of a rare earth magnet, such as a neodyum magnet, which is a permanent magnet having a very high magnetic force. This allows the drive motor 60 to be compact and provide a high driving force. In addition, a detecting magnet 83 is mounted onto the spindle shaft 54 under the rotor magnet 82 to detect the rotation speed of the spindle shaft 54. The detecting magnet 83 is composed a plastic magnet that composes a permanent magnet having a weak magnetic force (its magnetic force being weaker than that of the rotor magnet 82). A magnetic sensor is located opposite to the detecting magnet 83.

A fitting portion 77*b*, in which the motor supporting portion 76 is fitted, is formed along the inner circumferential surface of the lower end of the upper supporting member 77 constituting the motor housing 84, and another fitting portion 76*b*, which is configured to have a smaller diameter than the fitting portion 77*b*, is formed at the upper end of the motor supporting portion 76. By fitting the fitting portion 76*b* of the motor supporting portion 76 and the fitting portion 77*b* of the upper supporting member 77 together, both supporting portions 76 and 77 are coupled together in such a way that the outer circumferential surface of the fitting portion 76*b* and the inner circumferential surface of the fitting portion 77*b* contact each other. By coupling both supporting portions together in this manner, the upper supporting portion 77 is prevented from interfering with the inner circumferential surface of the motor supporting portion 76, thereby enabling the stator coil 81 mounted onto the inner circumferential surface of the motor supporting portion 76 to be located near the upper end of the motor supporting portion 76. Thus, in the drive motor 60, the motor portion, which is composed of the stator coil 81 and the rotor magnet 82, can be located as high up as possible, thereby enabling the interval E (shown in FIG. 17) between the upper rotating disc 65 and the motor portion to be reduced.

Since the interval between the motor portion of the drive motor 60 that rotates the spindle shaft 54 and the rotating disc 65 that rotates integrally with the spindle shaft 54 is reduced in this manner, even if a high power drive motor 60 is used to rotate the spindle 54 at high speeds, deflections of the spindle shaft 54 can be minimized, and the spindle shaft 54 can therefore rotate stably at high speeds.

In addition, the fitting portions of the motor supporting portion 76 and the lower supporting member 78 are fitted together so that the inner circumferential surface of the motor supporting portion 76 contacts the outer circumferential surface of the lower supporting member 78. The lower supporting member 78 is mounted on the frame 9 by using a bolt on the outer circumferential side of the fitted portion between the motor supporting portion 76 and the lower supporting member 78.

In addition, the upper supporting member 77, which supports the spindle shaft 54 via the bearing 77*a*, and the lower supporting member 78, which supports the spindle shaft 54 via the bearing 78*a*, are composed of a material such as iron having a higher rigidity than aluminum that constitutes the motor supporting portion 76. Consequently, the upper supporting member 77 and the lower supporting member 78 can firmly support the spindle shaft 54 to provide high durability. Thus, even if the drive motor 60 rotates the spindle shaft 54 at high speeds, deflection of the spindle shaft 54 can be minimized and the spindle shaft 54 can rotate stably at high speeds. Consequently, stable high speed rotation can be achieved even above long periods of continuous operation.

Figure 13:
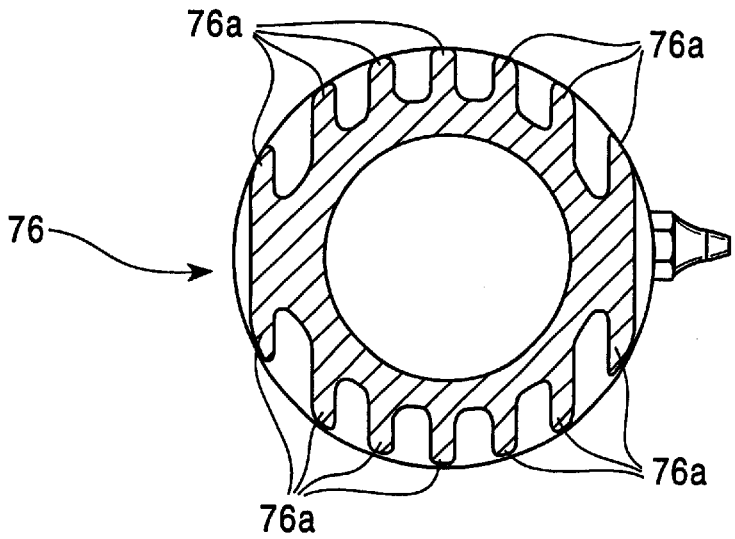
FIG. 13 is a top sectional view showing a motor supporting portion constituting a motor housing of the drive motor.
Figure 14:
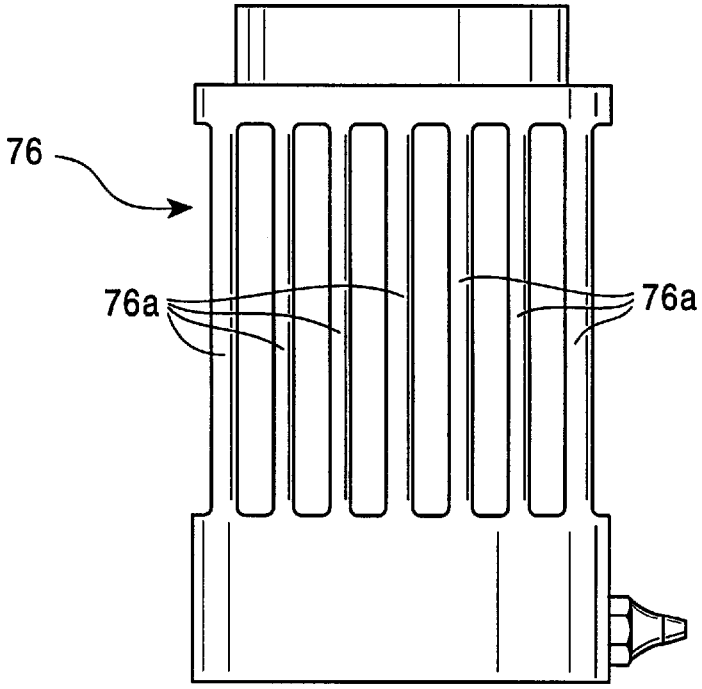
FIG. 14 is a top sectional view showing a motor supporting portion constituting the motor housing of the drive motor.

As shown in FIGS. 13 and 14, a plurality of fins 76*a*, 76*a*, . . . protruding outward are formed on the outer circumference of the motor supporting portion 76 constituting the motor housing 84. The fins 76*a*, 76*a*, . . . are provided in the vertical direction so as to efficiently remove heat generated by operation of the drive motor 60. That is, when the drive motor 60 drives the rotating spindle shaft 54 to rotate the rotating disc 65, the air flows from the center of the rotating disc 65 towards the outside due to the rotational motion. Due to this flow, the air flows upward from under the rotating disc 65 and along the drive motor 60. When the air flow caused by the rotation of the rotating disc 65 passes through the motor housing 84 of the drive motor 60, it removes heat from the outer circumferential surface of the motor housing 84 and thus cools the drive motor 60.

Since the fins 76*a*, 76*a*, . . . are formed on the motor supporting portion 76 of the motor housing 84 with the motor portion of the drive motor 60 installed inside, the outer circumferential surface of the motor supporting portion 76 is increased, and the air flow efficiently cools the drive motor 60. In addition, because the fins 76*a*, 76*a*, . . . are arranged in the vertical direction, the air flows along the side wall of each of the fins 76*a* (that is, along the grooves between the fins 76*a*) to enable heat to be efficiently removed from the outer circumferential surfaces of the fins 76*a*.

Furthermore, since the motor supporting portion 76 with the fins 76*a* formed thereon is composed of aluminum having a high thermal conductivity, the motor supporting portion 76 appropriately radiates heat to enable efficient cooling. If, for example, a powerful drive motor 60 is used and accordingly the amount of heat generated during operation is high, the motor housing 84 can be configured to have a cooling structure that provides a high cooling effect as described above, thereby enabling the drive motor 60 to be efficiently cooled and ensuring sufficient cooling overall. The sufficient cooling effect in turn enables the drive motor 60 to provide the high driving forces required to drive the rotating spindle shaft 54 efficiently.

In addition, because the motor supporting portion 76 of the motor housing 84 is composed of aluminum, which is a non magnetic substance, magnetic interference does not occur between the motor supporting portion 76 and the rotor magnet 82 installed inside it, and thus the drive forces are not hindered in any way. Consequently, the drive motor 60 can provide sufficient power to drive the rotating spindle shaft 54 more efficiently.

In addition, through a lubricating oil supply port formed in the side of the motor housing 84 of the motor magnet 82, a lubricating oil such as grease is supplied to the bearings 77*a* of the upper supporting member 77 and the bearing 78*a* of the lower supporting member 78, which rotatably support the spindle shaft 54 driven by the drive motor 60.

Figure 15:
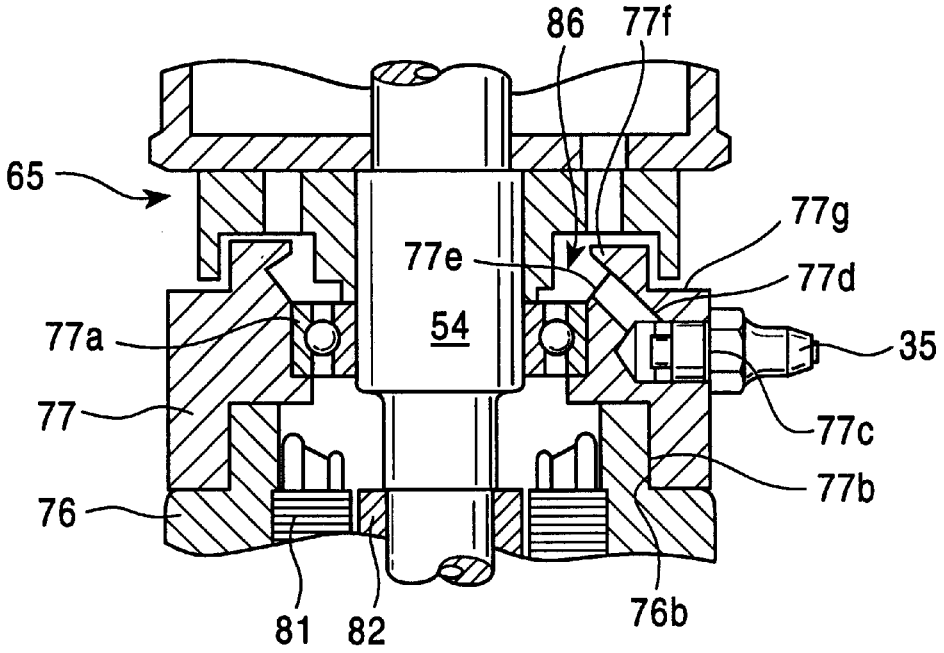
FIG. 15 is a side sectional view showing a portion for supplying a lubricating oil to a bearing of an upper supporting member.

That is, as shown in FIG. 15, to supply the lubricating oil to the bearing 77*a* of the upper supporting member 77, a lubricating oil passage 77*d* is formed so as to penetrate the upper supporting member 77 for the motor housing 84, and the lubricating oil is supplied through the lubricating oil passage 77*d* to the bearing 77*a* from an upper lubricating oil supply port 77*c* where the lubricating oil passage 77*d* opens in the outer side of the upper supporting member 77.

The upper lubricating oil supply port 77*c* is located laterally along the outer circumferential surface of the bearing 77*a*, that is, radially outside the bearing 77*a*, and the lubricating oil passage 77*d* extends inward in a roughly horizontal direction from the upper lubricating oil supply port 77*c* up to a midway position, and then inclines inward and upward to a passage outlet 77*e* that serves as the end of the lubricating oil passage 77*d*. The passage outlet 77*e* opens onto the inner circumferential surface of the upper supporting member 77 and is located above the bearing 77*a*, and above the passage outlet 77*e*, and the inner circumferential surface of the upper supporting member 77 protrudes inward beyond the passage outlet 77*e* to form a protruding portion 77*f*. The upper lubricating oil supply port 77*c* may be located slightly below the outer circumferential surface of the bearing 77*a*.

The lubricating oil is then supplied from the upper lubricating oil supply port 77*c* through the lubricating oil passage 77*d* down to the bearing 77*a*. In this case, since the passage outlet 77*e* is located above the bearing 77*a*, the lubricating oil supplied through the passage outlet 77*e* into a space 86 inside the upper supporting member 77 is reliably supplied to the lower bearing 77*a*. In addition, the protruding portion 77*f*, which protrudes inward, is formed above the passage outlet 77*e* of the lubricating oil passage 77*d*, so the lubricating oil supplied in the space 86 through the passage outlet 77*e* is prevented from traveling upward and instead travels downward so as to be more reliably supplied to the lower bearing 77*a*. By fitting a nipple 35 in the lubricating oil passage 77*d* through the upper lubricating oil supply port 77*c*, the upper lubricating oil supply port 77*c* is constantly occluded except when the lubricating oil is being supplied, thereby preventing the lubricating oil from leaking to the exterior through the upper lubricating oil supply port 77*c*.

In addition, the upper lubricating oil supply port 77*c* is located along the outer circumferential surface of the bearing 77*a*, and a notch 77*g* can be formed by cutting out the outer circumferential surface of the upper end of the upper supporting member 77 that is located above the upper lubricating oil supply port 77*c*. The rotating disc 65 is located down low so that the outer circumferential surface of the lower end of the rotating disc 65 is located at the notch 77*g*.

Locating the rotating disc 65 down low in this manner can reduce the interval E between the rotating disc 65 and the motor portion installed inside the motor supporting portion 76, thereby making it possible to reduce the height of the twisting unit 51. This configuration prevents deflections of the spindle shaft 54 and enables it to rotate stably at high speeds.

Figure 16:
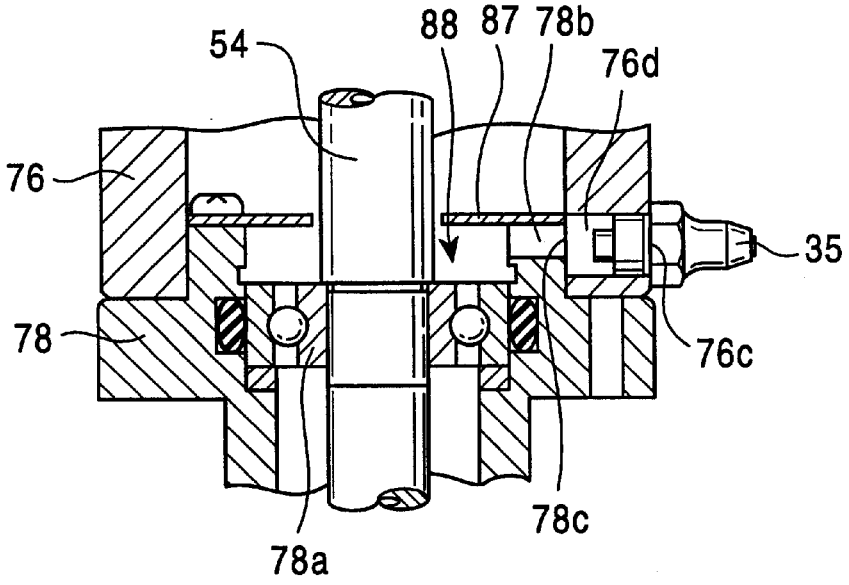
FIG. 16 is a side sectional view showing a portion for supplying a lubricating oil to a bearing of a lower supporting member.

In addition, as shown in FIG. 16, to supply the lubricating oil to the bearing 78*a* of the lower supporting member 78, the fitted portion between the motor supporting portion 76 and the lower supporting member 78 forms a lubricating oil passage 76*d* that penetrates the side wall of the motor supporting portion 76 and a lubricating oil passage 78*b* that penetrates the side wall of the lower supporting member 78. The lubricating oil passages 76*d* and 78*b* are in communication with each other, and the lubricating oil passage 76*d* opens onto the outer circumferential surface of the motor supporting portion 76 as a lubricating oil supply port 76*c*. The lower lubricating oil supply port 76*c* is located laterally along the outer circumferential surface of the bearing 78*a*, that is, radially outside the bearing 78*a*. The lubricating oil is then supplied from the lower lubricating oil supply port 76*c* through the lubricating oil passages 76*d* and 78*b* to the bearing 78*a*.

A passage outlet 78*c* formed by opening the lubricating oil passage 78*b* of the lower supporting member 78 onto the inner circumferential surface of the lower supporting member 78 is located above the bearing 78*a*, and a seal member 87 that protrudes inward to occlude the gap extending from the inner side of the lower supporting member 78 to the spindle shaft 54 is disposed above the passage outlet 78*c*. The seal member 87 prevents the lubricating oil supplied through the passage outlet 78*c* into the space 88 inside the lower supporting member 78 from traveling up beyond the seal member 87, thereby allowing the oil to be reliably supplied to the bearing 78*a* located under the space 88. In addition, by fitting a nipple 35 in the lubricating oil passage 76*d* through the lower lubricating oil supply port 76*c*, the lower lubricating oil supply port 76*c* is constantly occluded except when the lubricating oil is being supplied, thereby preventing the lubricating oil from leaking to the exterior through the lower lubricating oil supply port 76*c*.

As described above, the lubricating oil is supplied to the bearing 77*a* of the upper supporting member 77 and the bearing 78*a* of the lower supporting member 78 through the upper lubricating oil supply port 77*c* and the lower lubricating oil supply port 76*c*, respectively. This configuration enables the lubricating oil to be externally supplied while the spindle shaft 54 is being supported by the bearings 77*a* and 78*a*, thereby simplifying the lubricating oil supply operation and enabling the individual-spindle-drive type multiple twister to be more compact.

In addition, because the lubricating oil supply port 77*c* through which lubricating oil is externally supplied is formed along the side of the upper supporting member 77 so as to be located along the outer circumferential surface of the bearing 77*a*, the lubricating oil can be easily supplied to the bearing 77*a* and the height of the twisting unit 51 can be reduced.

Moreover, because the passage outlet 77*e* of the lubricating oil passage 77*d* in the upper supporting member 77 is located above the bearing 77*a* and the protruding portion 77*f* protruding inward is formed above the passage outlet 77*e*, the lubricating oil can be efficiently and reliably supplied to the bearing 77*a*. Likewise, because the passage outlet 78*c* of the lubricating oil passage 78*b* in the lower supporting member 78 is located above the bearing 78*a*, and because the seal member 87 that protrudes inward is provided above the passage outlet 78*c*, the lubricating oil can be efficiently and reliably supplied to the bearing 78*a*.

In addition, to supply the lubricating oil to the bearing 78*a* of the lower supporting member 78, the lubricating oil supply port 76*c* and the lubricating oil passages 76*d* and 78*b* are formed in the fitted portion between the motor supporting portion 76 and the lower supporting member 78, and the lubricating oil passages 76*d* and 78*b* are in communication with each other. Thus, compared to, for example, a configuration in which the lubricating oil supply port and the lubricating oil passage are formed in the lower supporting member 78 to supply the lubricating oil from above the bearing 78*a*, the fitted portion between the motor supporting portion 76 and the lower supporting member 78 can be located closer to the bearing 78*a*, and the height of the drive motor 60 can thus be reduced. This configuration enables the lubricating oil to be easily supplied to the bearing 78*a* while keeping the height of the twisting unit 1 to a minimum.

As described above, the drive motor 60 is configured as a DC brushless motor capable of driving a rotating spindle at high speeds. The rotor magnet 82, which constitutes a permanent magnet having a high magnetic force, is fixed to the spindle shaft 54, and the stator coil 81, including the iron core 81*a*, is located on the outer circumferential surface of the rotor magnet 82, and moreover, the stator coil 81 and the rotor magnet 82 are housed within the motor housing 84.

To assemble the drive motor 60, the motor housing 84 is configured by mounting the upper supporting member 77 and the lower supporting member 78 on the motor supporting portion 76 and fixing the stator coil 81 to the inner circumference of the motor supporting portion 76, and the spindle shaft 54 with the rotor magnet 82 fixed to its outer circumferential surface is then inserted into the motor housing 84 from above so as to fit into the bearing 77*a* of the upper supporting member 77, and the spindle shaft 54 is then further inserted so as to fit into the bearing 78*a* of the lower supporting member 78, and is then inserted down to a position where the stator coil 81 and the rotor magnet 82 are opposed to each other.

Figure 17:
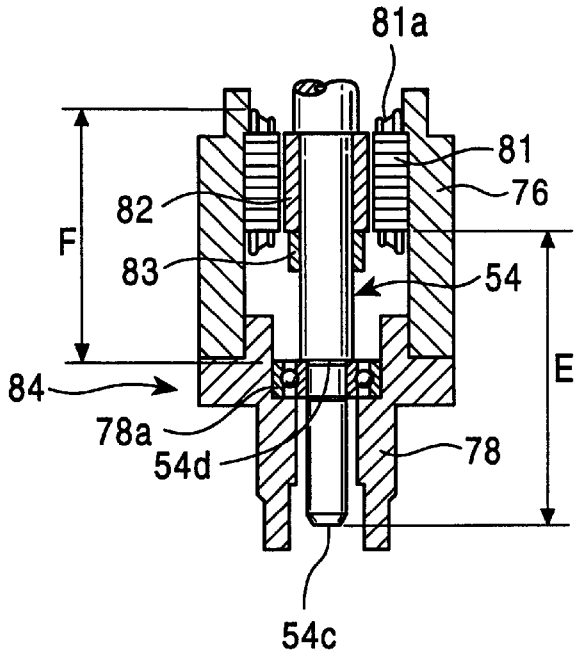
FIG. 17 is a side view showing the relationship between the distance from the lower end of a rotor magnet to the lower end of a spindle shaft and the distance from the upper end of a stator coil to a bearing of the lower supporting member.

As shown in FIG. 17, once the drive motor 60 is assembled by inserting the spindle shaft 54 into the motor housing 84 in the above manner, the distance E between the lower end of the rotor magnet 82 fixed to the spindle shaft 54 and the lower end of the spindle shaft 54 is larger than the distance F between the upper end of the iron coil 81*a* of the stator coil 81 fixed to the motor supporting portion 76 and the bearing 78*a* of the lower supporting member 78 located under the motor supporting portion 76 (under the motor).

Figure 18:
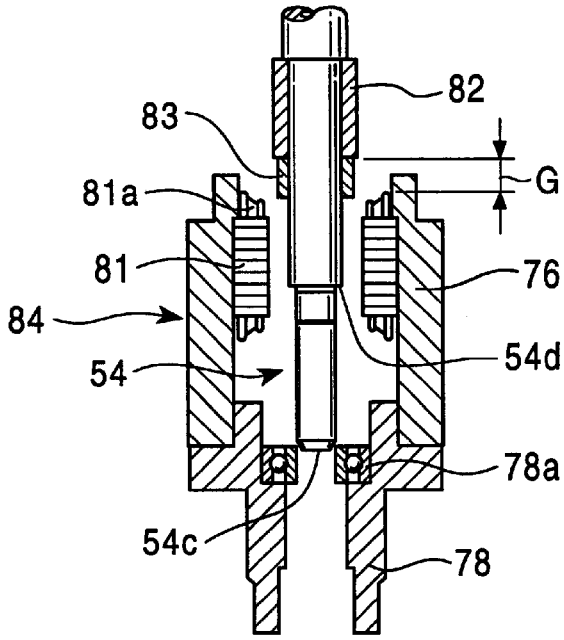
FIG. 18 is a side view showing a state in which a spindle shaft is inserted into the motor housing down to a position at which it fits the bearing of the lower supporting member.

Since the distance E is larger than the distance F, when the spindle shaft 54 is inserted into the motor housing 84 until it reaches a position where it is fitted into the bearing 78*a* of the lower supporting member 78 as shown in FIG. 18, the lower end of the rotor magnet 82 separates a distance G upward from the upper end of the iron core 81*a* of the stator coil 81. This prevents a strong attractive force from being generated between the rotor magnet 82 and the stator coil 81. Thus, until the spindle shaft 54 inserted from the upper end of the motor housing 84 is fitted into the bearing 78*a* of the lower supporting portion 78, the insertion position of the spindle shaft 54 is not affected by the attractive force generated between the rotor magnet 82 and the stator coil 81, thereby enabling the spindle shaft 54 to be easily fitted into the bearing 78*a* of the lower supporting member 78.

In the configuration shown in FIG. 18, the detecting magnet 83 provided under the rotor magnet 82 for detecting the rotation speed of the spindle shaft 54 is also located at the upper end of the iron core 81*a* of the stator coil 81. Consequently, a strong attractive force is not generated between the detecting magnet 83 and the stator coil 81. In addition, because the magnet force of the detecting magnet 83 is relatively weak, a strong attractive force is not generated between the detecting magnet 83 and the stator coil 81 even if they are opposed to each other, thereby preventing the insertion position of the spindle shaft 54 from being affected.

In other words, since the detecting magnet 83 having a weaker magnetic force than the rotor magnet 82 is provided under the rotor magnet 82, the using amount of the expensive rotor magnet 82 can be suppressed to the utmost, and the wiring from the magnetic sensor can be simplified. In addition, during insertion, the spindle shaft 4 is not significantly affected by the magnetic force generated between the detecting magnet 83 and the iron core 81*a*, thereby enabling the length of the spindle shaft 4 to be minimized.

After being inserted in the bearing 78*a* of the lower supporting member 78, the spindle shaft 54 is further inserted down to a position where the rotor magnet 82 and the stator coil 81 are opposed to each other. In this configuration, the rotor magnet 82 is located close to the stator coil 81 to effect a strong attractive force between them. But because the spindle shaft 54 is supported by the bearing 77*a* of the upper supporting member 77 and the bearing 78*a* of the lower supporting member 78, the rotor magnet 82 and the stator coil 81 are prevented from adhering to each other, and thus the spindle shaft 54 can be inserted smoothly.

In addition, the tip 54*c* of the spindle shaft 54 is tapered diameter so that, when inserted into the motor housing 84, the spindle shaft 54 can be fitted easily into the bearing 78*a* of the lower supporting member 78. This configuration enables the spindle 54 to be fitted into the bearing 78*a* more easily.

Moreover, the spindle shaft 54 has formed therein a step portion 54*d* that engages with and locks onto the bearing 78*a* of the lower supporting member 78 when the drive motor 60 is assembled. With the step portion 54*d* formed in the spindle shaft 54, during the assembly of the drive motor 60, when the spindle shaft 54 is fitted into the bearing 78*a* of the lower supporting member 78 and is further inserted toward the bottom of the motor housing 84 to reach the position where the rotor magnet 82 and the stator coil 81 are opposed to each other, then the step portion 54*d* engages with and locks onto the bearing 78*a* to prevent the spindle shaft 54 from being further inserted. This configuration enables the vertical insertion point of the spindle shaft 54 to be determined easily and accurately when the drive motor 60 is assembled, thereby allowing the assembly operation for the drive motor 60 to be performed simply and reliably.

By providing an individual-spindle-drive type multiple twister configured as described above, the present invention provides the following benefits.

First, the spindle shaft, at least, is rotatably supported by a bearing in the lower portion of the motor, and the distance between the lower end of the rotor, which is a permanent magnet fixed to the spindle shaft, and the lower end of the spindle shaft is longer than the distance between the upper end of the stator fixed to the housing of the motor and the bearing in the lower portion of the motor. Thus, until the spindle shaft which is inserted downward through the upper end of the motor housing and the bearing installed inside, is fitted into the bearing in the lower portion of the motor, the insertion position of the spindle shaft is not affected by the attractive force generated between the motor's rotor and stator, which are fixed to the housing, and this enables the spindle shaft to be fitted easily into the bearing in the lower portion of the motor.

In addition, when the spindle shaft is fitted into the bearing in the lower portion of the motor and is further inserted downward, a strong attractive force is effected between the rotor and stator of the motor. In this configuration, however, both the bearings above and under the motor support the spindle shaft to prevent the rotor and the stator from adhering to each other. As a result, the spindle shaft can be inserted smoothly, and the motor can be assembled easily and reliably.

Furthermore, the lower end of the spindle shaft is tapered by reducing its diameter. Consequently, the spindle shaft can be inserted and fitted easily into the bearing in the lower portion of the motor, and the motor can be assembled easily and reliably.

Moreover, the spindle shaft has formed therein a step portion that engages with and locks onto the bearing in the lower portion of the motor when the motor is assembled. Accordingly, when the motor is being assembled, the vertical insertion point of the spindle shaft can be determined easily and accurately, thereby allowing the motor assembly operation to be performed simply and reliably.

By providing an individual-spindle-drive type multiple twister configured as described above, the present invention provides the following benefits.

The housing of the motor comprises the motor supporting portion having a stator installed along its inner circumferential surface, an upper supporting member mounted at the upper end of the motor supporting portion to support the spindle shaft via the bearing, and a lower supporting member mounted at the lower end of the motor supporting portion to support the spindle shaft via the bearing. Moreover, the motor supporting portion is composed of a non magnetic material. Accordingly, magnetic interference does not occur between the motor supporting portion and the motor portion installed inside the motor supporting portion, and thus the drive force of the motor is not hampered or reduced in any way. Consequently, the motor can provide enough power to drive the rotating spindle shaft efficiently.

In addition, because the upper supporting member and the lower supporting member comprise members having a higher rigidity than the motor supporting portion, they can firmly support the spindle shaft and thus ensure high durability.

Consequently, even if the motor rotates the spindle shaft at high speeds, deflections of the spindle shaft can be prevented and the spindle shaft can rotate stably at high speeds, thereby ensuring stable high speed rotation even above long periods of continuous operations.

Furthermore, the fitting portion that fits the upper supporting member is formed at the upper end of the motor supporting portion so that the motor supporting portion and the upper supporting member are fitted together in such a way that the outer circumferential surface of the fitting portion contacts the inner circumferential surface of the upper supporting member. Thus, the motor portion installed inside the motor supporting portion can be located as high as possible, thereby reducing the interval between the rotating disc located above the motor and the motor portion.

Consequently, even if a powerful motor is used to drive the rotating spindle shaft at high speeds, deflections of the spindle shaft can be prevented, and the spindle shaft can rotate more stably at high speeds.

Moreover, the motor supporting portion is composed of aluminum. The high thermal conductivity and good radiation property of aluminum serve to cool the motor efficiently, thereby enabling sufficient cooling.

Moreover, the rotating disc that rotates integrally with the spindle shaft is located above the motor, the twisting unit is supported under the motor, and the vertical fins are disposed along the outer circumferential surface of the motor supporting portion. Accordingly, the surface area of the outer circumferential surface of the motor supporting portion can be increased so as to allow the air to flow along the side wall portions of the fins as the rotating disc rotates, thereby removing heat from the overall outer circumferential surfaces of the fins efficiently. Consequently, heat generated from the motor can be efficiently removed, and a high level of cooling is achieved. As a result, even if the the motor generates a great deal of heat, the motor can be cooled sufficiently.

By providing an individual-spindle-drive type multiple twister configured as described above, the present invention provides the following benefits.

The bearing support portion for rotatably supporting the spindle shaft via the bearing is disposed on the motor housing with a stator fixed thereto, the bearing support portion has a lubricating oil supply port for externally supplying lubricating oil to the bearing, and a lubricating oil passage that guides the lubricating oil from the lubricating oil supply port to the bearing, and a lubricating oil passage is located along the outer circumference of the bearing. Thus, the lubricating oil can be externally supplied while the spindle shaft is being supported, thereby simplifying the lubricating oil supply operation and enabling the individual-spindle-drive type multiple twister to be more compact. In addition, the lubricating oil can be easily supplied to the bearing while keeping the height of the twisting unit to a minimum.

Furthermore, the lubricating oil passage has an inclined section that inclines in the vertical direction. The outlet of the lubricating oil passage, which opens onto the inner circumferential surface of the bearing support portion, is located above the bearing, and the protruding portion that protrudes inward in the radial direction is formed above the passage outlet in the bearing support portion. As a result, the lubricating oil can be supplied to the bearing efficiently and reliably.

Furthermore, the housing of the motor is configured by fitting together the motor supporting portion with the stator fixed thereto and the bearing support portion, which is fabricated separately from the motor supporting portion, that rotatably supports the spindle shaft via the bearing. The lubricating oil passage, which penetrates the side wall of the motor supporting portion, and the lubricating oil passage, which penetrates the side wall of the bearing support portion, are formed in the fitting portion between the motor and bearing support portions to allow both lubricating oil passages to communicate with each other. Thus, the lubricating oil can be externally supplied while the spindle shaft is being supported by the bearing, thereby simplifying the lubricating oil supply operation and enabling the individual-spindle-drive type multiple twister to be more compact.

In addition, the height of the motor can be reduced, and the lubricating oil can be easily supplied to the bearing while controlling the height of the twisting unit.

What is claimed is:

1. An individual-spindle-drive type multiple twister having a motor to directly rotate a spindle shaft of a twisting unit, characterized in that a housing of the motor comprises a motor supporting portion having a stator installed on its inner circumferential surface, an upper supporting member mounted at the upper end of the motor supporting portion to support the spindle shaft via a bearing, and a lower supporting member mounted at the lower end of the motor supporting portion to support the spindle shaft via a bearing; in that the motor supporting portion comprises a non-magnetic substance; and in that the upper supporting member and the lower supporting member comprise members having a higher rigidity than the motor supporting member.

2. An individual-spindle-drive type multiple twister according to claim 1 characterized in that a fitting portion that fits said upper supporting member is formed at the upper end of said motor supporting member so that the motor supporting portion and the upper supporting member are fitted together in such a way that the outer circumferential surface of the fitting portion contacts the inner circumferential surface of the upper supporting member.

3. An individual-spindle-drive type multiple twister according to claim 1 or claim 2 characterized in that said motor supporting portion comprises aluminum.

4. An individual-spindle-drive type multiple twister according to claim 1 or claim 2 characterized in that a rotating disc that rotates integrally with the spindle shaft is located above said motor, in that the twisting unit is supported under the motor, and in that vertical fins are formed on the outer circumferential surface of said motor supporting portion.

* * * * *